US006413599B1

(12) United States Patent
Petricca et al.

(10) Patent No.: US 6,413,599 B1
(45) Date of Patent: Jul. 2, 2002

(54) SEALED CONTAINER FOR AN ARTICLE OF PERSONAL USE SUCH AS A RAZOR CARTRIDGE

(75) Inventors: John D. Petricca, Leominster; Arthur Feehan, Lunenburg, both of MA (US); James Larry Webb, Pittsford, NY (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 09/364,243

(22) Filed: Jul. 29, 1999

(51) Int. Cl.[7] ..... B65D 85/00

(52) U.S. Cl. ..... 428/35.7; 206/484; 206/484.2; 220/359.1; 220/359.2; 220/359.3; 220/359.4; 428/423.1; 428/424.4; 428/424.8; 428/461; 428/483

(58) Field of Search ..... 428/423.1, 424.4, 428/424.8, 461, 483, 35.7, 500, 516, 523, 704, 539.5; 220/359.3, 359.2, 359.1, 359.4; 206/484, 484.2, 352–360

(56) References Cited

U.S. PATENT DOCUMENTS

| | | | | |
|---|---|---|---|---|
| 1,489,379 | A | 4/1924 | Zeller | |
| D90,931 | S | 10/1933 | Wanders | |
| 1,986,230 | A | 1/1935 | Talbot | 206/46 |
| 2,075,178 | A | 3/1937 | Copeman | 93/2 |
| 2,138,241 | A | 11/1938 | Koch et al. | 206/56 |
| 2,194,281 | A | 3/1940 | Gustafson | 206/46 |
| 2,518,423 | A | 8/1950 | Jenett | 18/59 |
| 2,822,916 | A | 2/1958 | Wark et al. | 206/16 |
| 2,849,109 | A | 8/1958 | Rommel | 206/46 |
| 3,045,812 | A | 7/1962 | Randolph | 206/16 |
| 3,084,791 | A | 4/1963 | Hawley et al. | 206/16 |
| 3,095,965 | A | 7/1963 | Stahl et al. | 206/16 |
| 3,367,482 | A | 2/1968 | Samsing | 206/16 |
| 3,933,245 | A | 1/1976 | Mullen | 206/498 |
| 3,970,194 | A | 7/1976 | Iten | 206/356 |
| 3,972,417 | A | 8/1976 | Iten et al. | 206/354 |
| 4,095,691 | A | 6/1978 | Iten | 206/354 |
| RE29,937 | E | 3/1979 | Mahaffy et al. | 53/511 |
| D253,040 | S | 10/1979 | Fournier et al. | D9/192 |
| D253,167 | S | 10/1979 | Fournier et al. | D9/185 |
| 4,285,428 | A | 8/1981 | Beddall et al. | 206/354 |
| 4,452,842 | A | 6/1984 | Borges et al. | 428/195 |
| 4,539,259 | A | 9/1985 | Zuscik | 428/332 |
| 4,574,104 | A | 3/1986 | Aishima et al. | 428/220 |
| 4,656,068 | A | 4/1987 | Raines | 428/35 |
| 4,659,408 | A | 4/1987 | Redding | 156/244.17 |
| 4,701,359 | A | 10/1987 | Akao | 428/35 |
| 4,807,745 | A | 2/1989 | Langley et al. | 206/245 |
| D306,216 | S | 2/1990 | Gray | D28/45 |
| 4,943,780 | A | 7/1990 | Redding | 428/35.9 |
| 5,082,112 | A | 1/1992 | Dunklee | 206/363 |
| 5,092,469 | A | 3/1992 | Takata et al. | 206/245 |
| 5,105,942 | A | 4/1992 | van Veen et al. | 206/364 |
| 5,131,539 | A | 7/1992 | Karita et al. | 206/462 |
| 5,134,775 | A | 8/1992 | Althaus et al. | 30/41 |
| 5,144,942 | A | 9/1992 | Decarie et al. | 128/4 |
| 5,176,258 | A | 1/1993 | Antal | 206/461 |

(List continued on next page.)

FOREIGN PATENT DOCUMENTS

| | | |
|---|---|---|
| AU | AU-B-75184/91 | 12/1991 |
| CA | 926760 | 5/1973 |
| DE | 197 51 428 A1 | 5/1998 |
| EP | 0 548 785 A1 | 6/1993 |
| FR | 2 714 031 | 6/1995 |

*Primary Examiner*—C. Melissa Koslow
*Assistant Examiner*—Shalie Manlove
(74) *Attorney, Agent, or Firm*—Edward S. Podszus

(57) ABSTRACT

A sealed package for an article of personal use. The package includes a plastic container that defines a storage region and has a sealing surface around an entrance to the region. The package also includes a plastic, multi-layer laminate film sealed to the sealing surface of the container. The film is removable away from the sealing surface in one piece and has deadfold characteristics.

40 Claims, 4 Drawing Sheets

U.S. PATENT DOCUMENTS

| | | | | | |
|---|---|---|---|---|---|
| 5,183,706 | A | * | 2/1993 | Bekele | 428/349 |
| 5,230,948 | A | | 7/1993 | Preiss et al. | 428/213 |
| D345,233 | S | | 3/1994 | Gray | D28/47 |
| 5,314,749 | A | | 5/1994 | Shah | 428/349 |
| 5,342,684 | A | | 8/1994 | Carespodi | 428/347 |
| 5,407,066 | A | | 4/1995 | Grange | 206/228 |
| 5,429,241 | A | | 7/1995 | Althaus | 206/471 |
| 5,506,036 | A | | 4/1996 | Bergerioux | 428/213 |
| 5,586,677 | A | * | 12/1996 | Foos | 220/260 |
| 5,725,962 | A | | 3/1998 | Bader et al. | 428/515 |
| 5,783,266 | A | * | 7/1998 | Gehrke | 428/34.3 |
| 5,830,545 | A | | 11/1998 | Frisk | 428/34.7 |
| 5,879,028 | A | | 3/1999 | Benoit | 283/72 |
| 5,882,789 | A | * | 3/1999 | Jones et al. | 428/349 |
| 5,885,673 | A | | 3/1999 | Light et al. | 428/35.4 |
| 5,891,555 | A | | 4/1999 | O'Brien | 428/213 |
| 5,928,213 | A | * | 7/1999 | Barney et al. | 604/410 |
| 6,086,967 | A | * | 7/2000 | Whiteman et al. | 428/35.7 |

* cited by examiner

SEALED CONTAINER FOR AN ARTICLE OF PERSONAL USE SUCH AS A RAZOR CARTRIDGE

BACKGROUND OF THE INVENTION

The invention relates to containers for storing items such as shaving cartridges.

Shaving cartridges are typically sold in plastic dispensers containing a plurality of shaving cartridges located in respective sections of the container.

APPLICANTS' STATEMENT OF ACKNOWLEDGED PRIOR ART

It is known in the art of packaging snacks and condiments to have a rectangular formed plastic container generally in the shape of an open box with a peripheral rim, covered by a plastic foil sealed around the rim, and a pull tab which is then formed by a slitting knife shearing one corner of the rim diagonally such that the triangular tab remains attached to the sealing foil with no appreciable space between the triangular tab and the adjacent portion of the rim. For example, such packages have been used to package snacks that have been available in the United States under the trade designation "Phileas Fogg". Such prior art package is depicted in the accompanying FIGS. 1–2 labeled "prior art." Applicants understand the plastic container 100 is formed of a food-compatible thermoplastic with a rim 102 formed around the four sides (the rim being generally the same width on opposite sides, but of slightly different widths on adjacent sides), has a plastic covering film 104 sealed around the rim, the film being metallic-colored (believed to be by vacuum deposition) on the underside and printed with product information on the outside, and the pull tab 106 remaining adhered to the film when it is peeled back. Applicants have recognized that when the plastic film is peeled back from the plastic container but not completely removed therefrom and then let go, the film falls away from the position shown in FIG. 2 back to block the opening, and thus completely lacks any "deadfold" capability to leave the opening accessible as that term is discussed hereinbelow. It is known, however, that plastic food pack films have moisture and gas barrier properties to protect the product from becoming stale.

The acknowledged prior art also includes bendable metal foil used to cover plastic containers for patty-sized portions of butter, or similar packages for condiments or preserves such as have been available in the United States under the name Knotts Berry Farm Foods, Inc. (Placentia, Calif.); these containers also have a corner pull tab that has been provided by slitting a rim portion. The laminate cover foil is understood to be thin metal foil coated outside with plastic (with printed graphics) and having a heat seal adhesive under layer. The plastic coating merely provides moisture and gas barrier properties. The foil of these containers can be peeled back but must be made of metal so as to permit being permanently deformed.

The acknowledged prior art further includes a polyester coated paper layer with a sealant under layer such as hot melt adhesive, such as used in 6-pack individual serving yogurt containers such as believed to have been available in the United States under the name Yoplait. The polyester helps one-piece removal. The paper has some minimal ability to remain folded back, but lacks moisture barrier properties because it is absorbent.

SUMMARY OF THE INVENTION

The invention features, in general, a sealed package for an article of personal use. The package includes a plastic container that defines a storage region and has a sealing surface around an entrance to the region. The package also includes a plastic, multi-layer laminate film sealed to the sealing surface of the container. The film is removable away from the sealing surface in one piece and has deadfold characteristics.

Embodiments of the invention may include one or more of the following features. In particular embodiments, the plastic layers include at least one structural plastic layer and a further layer that is bondable to the sealing surface by heat sealing, ultrasonic welding, radio frequency (RF) welding, or by use in the layer of a pressure sensitive adhesive. The sealing layer preferably includes low density polyethylene (LDPE) and ethylene vinyl acetate (EVA). The at least one structural layer includes an outer layer including polyethylene terephthalate (PET). The film also includes a structural layer that includes high density polyethylene (HDPE); the HDPE layer is preferably underneath the PET layer, and more preferably is adjacent to the sealing layer. The film also includes a further structural layer that includes low density polyethylene (LDPE); this LDPE layer is underneath the PET layer, preferably sandwiched between the PET layer and the HDPE layer, to bond the HDPE and PET layers. The film also includes a thin polyester-urethane layer between the HDPE layer and the sealing layer, to bond the HDPE layer and the LDPE-EVA layer. The plastic layers do not conflict with electronic article surveillance (EAS) requirements. The laminate has moisture barrier properties. The laminate has chemical resistance properties. The laminate does not degrade when subjected to water and household cleaning agents, and does not delaminate during removal. The laminate carries printing on an internal surface of a layer. The container includes polypropylene. The laminate can include metallization, such as by vapor deposition, for a desired appearance.

Embodiments of the invention may include one or more of the following advantages. The laminate protects articles stored in the package from moisture, shaving preparation products such as soaps, foams and gels, and cleaning agents, has desired deadfold characteristics for ease of product removal, is less expensive than the known metal foils, does not tear during removal, is printable, and does not interfere with EAS systems. The deadfold characteristic permits opening the package for use without having to separate the lid completely from the container, which simplifies one-piece disposal and promotes good waste stream management and recycling of all-plastic materials.

Other advantages and features of the invention will be apparent from the following detailed description of the embodiments of the invention and from the claims.

DETAILED DESCRIPTION OF EMBODIMENTS OF THE INVENTION

Figure 1:
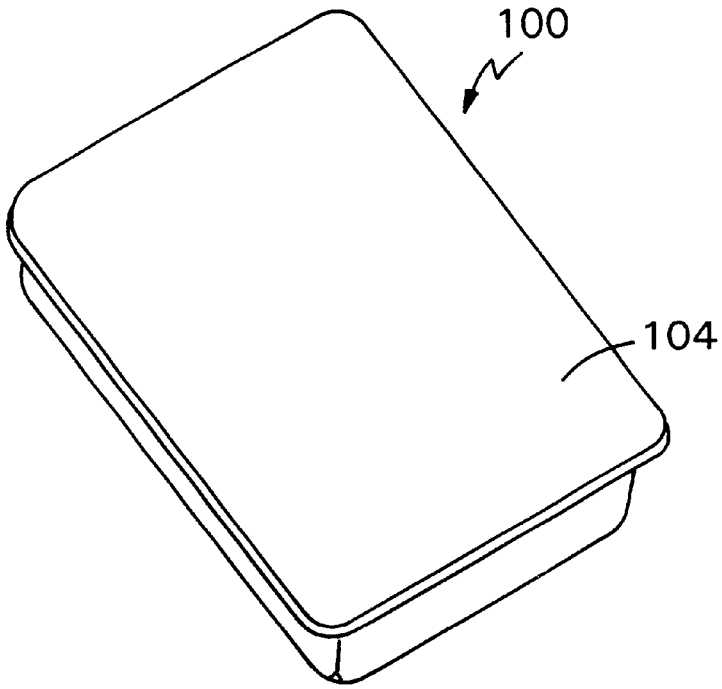
PRIOR ART FIG. 1
FIGS. 1–2 show a prior art sealed food container.
Figure 2:
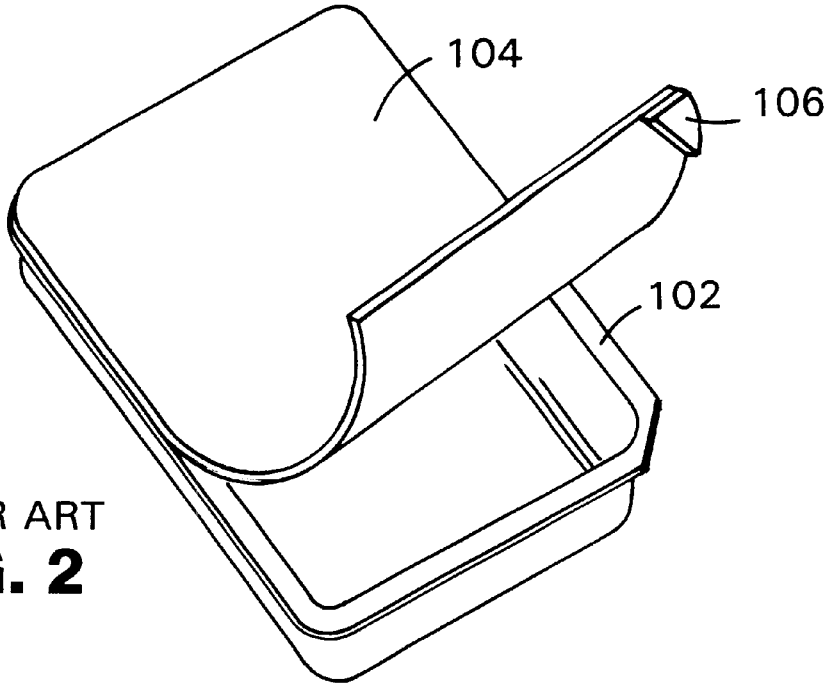
PRIOR ART FIG. 2
Figure 3:
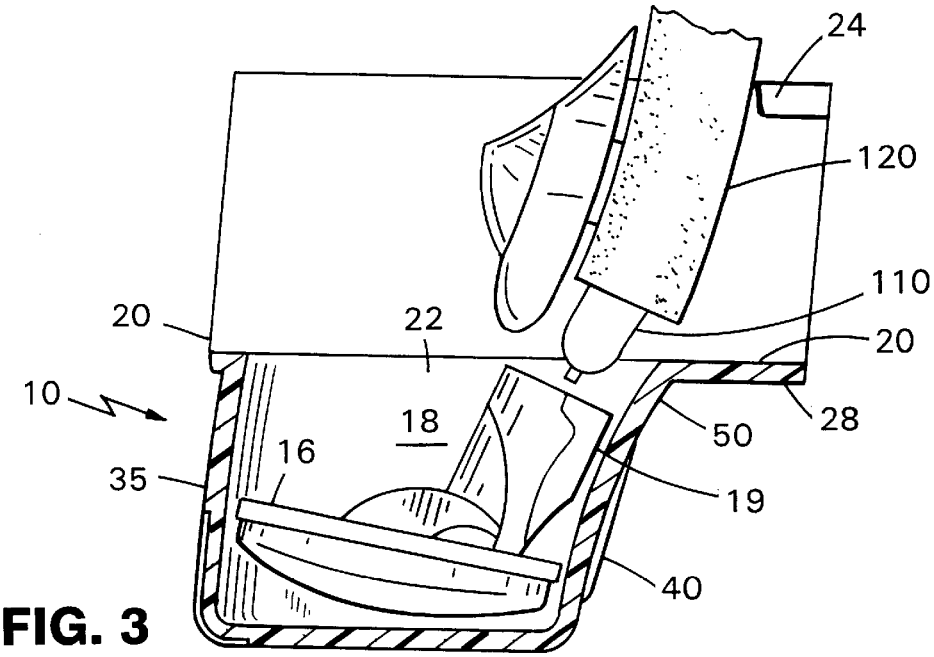
FIGS. 3–4 show a handle being connected to a razor cartridge contained in a sealed package that has been opened.
Figure 4:
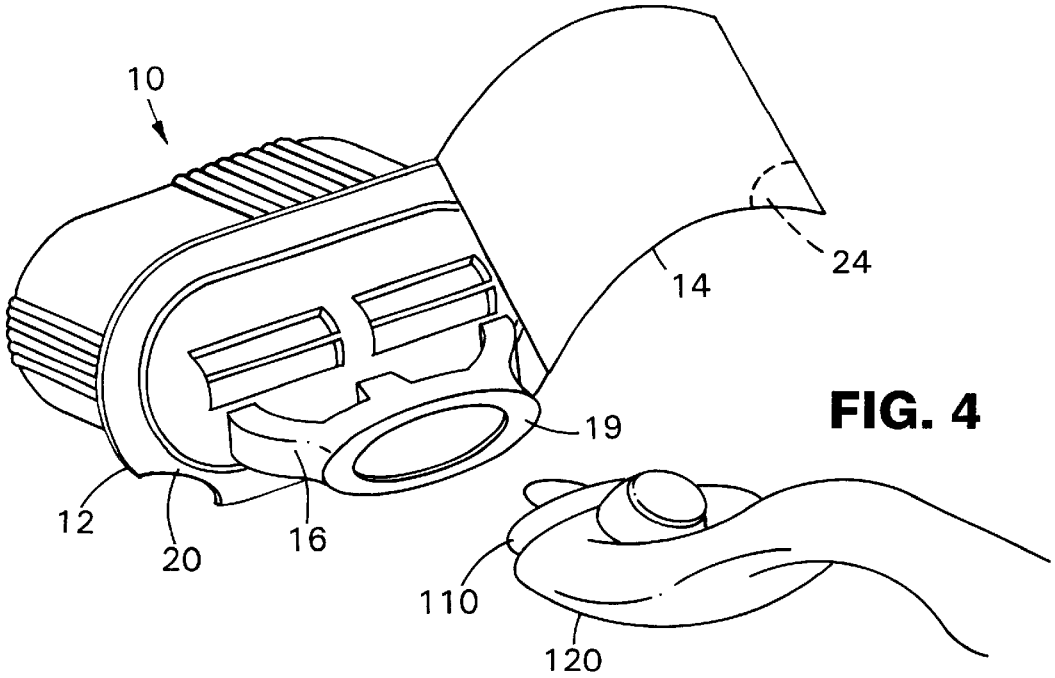

Referring to FIGS. 3 and 4, sealed package 10 is shown in a peeled open condition. Package 10 includes formed plastic container 12, cover sheet 14, and an article of personal use. Preferably the article of personal use is shaving cartridge 16 stored inside container 12 in storage region 18. This package can be used for an article of personal use such as a razor cartridge, disposable razor, toothbrush, replaceable toothbrush head, amount of dental floss, a battery, or a similar consumer product which, for example, could be sold through a vending machine. The connecting end 110 of handle 120 is shown being advanced toward connecting structure 19 of cartridge 16. Container 12 has a sealing surface 20 surrounding the entrance 22 to storage region 18, and cover sheet 14 is sealed to sealing surface 20. Plastic tabs 24 (only one is shown in FIGS. 3–4 and 6–7) are attached to an undersurface at two corners of cover sheet 14. Plastic tabs 24 are useful to initiate peeling of sheet 14.

In manufacture, container 12 is injection molded from polypropylene. Other materials that can be use for container 12 include polystyrene (particularly crystalline polystyrene, high impact polystyrene (HIPS),or medium impact polystyrene (MIPS)), polycarbonate, acrylonitrile butadiene styrene (ABS), Nylon, and SAN. In using materials other than polypropylene, one skilled in the art would select an appropriate sealing layer material for sealing layer 118 (shown in FIG. 5 and discussed below). After forming container 12, cartridge 16 is loaded into a container 12 in a desired connecting position with cartridge connecting structure 19 directed toward the entrance. Then cover sheet 14 is sealed to upper sealing surface 20 and to the upper surfaces of plastic tabs 24 by heat welding. Alternatively, radio frequency sealing, ultrasonic welding or a pressure sensitive adhesive could be employed.

Figure 5:
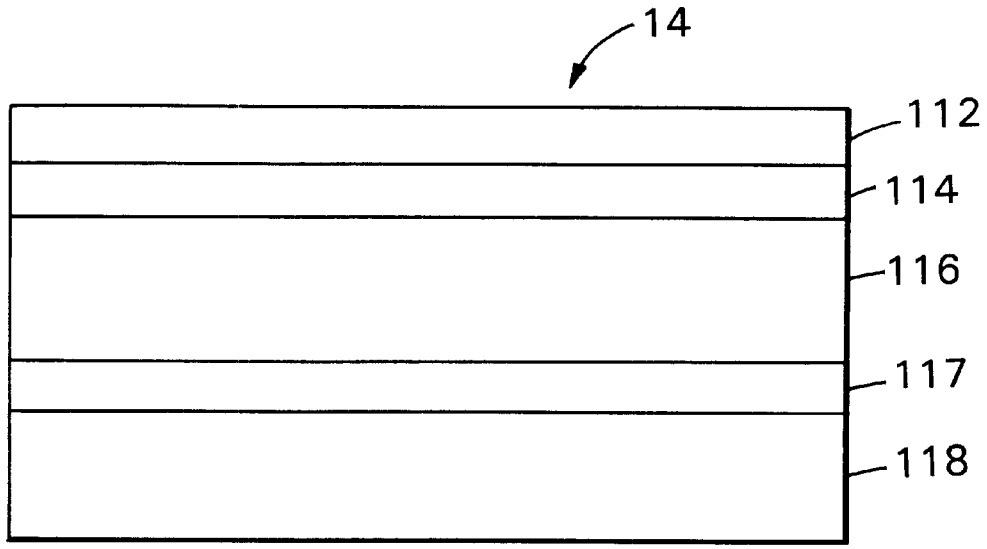
FIG. 5 shows the layered structure of the removable cover sheet of the FIG. 3 package.

Cover sheet 14 is printable, and can carry instructions for opening and use of a cartridge. Cover sheet 14 is made of a laminate as shown in FIG. 5 (not to scale). The laminate comprises 0.48 mil thick (0.012 mm, 48 gauge) PET upper layer 112 (which is reverse printed), 0.50 mil thick (0.013 mm, 50 gauge, alternatively referred to as "7.5 lbs./ream") polyethylene (preferably LDPE) layer 114 thereunder (which is preferably white for opacity, but could alternatively be transparent), 1.15 mil thick (0.029 mm, 115 gauge) oriented high density polyethylene layer (HDPE) 116 thereunder, 0.1 mil thick (approximately) (also referred to as about "2 lbs./ream") polyester-urethane adhesive layer 117 thereunder, and 1.25 mil thick (0.32 mm) coextruded LDPE-EVA(28%) lower sealing layer 118 thereunder, the lower EVA portion of which heat bonds to container 12.

In sheet 14, the HDPE layer, and to a lesser extent the LDPE layer, provide moisture barrier properties and deadfold characteristics. PET provides bulk and clarity and protection for the printing on its lower surface. PET also provides structural integrity for the laminate so as to avoid tearing and provide one-piece removal of the laminate. PET is selected that preferably withstands an accelerated testing regime of a 100° F. hot water bath for 24 hours without delamination. The polyethylene layer (preferably LDPE) acts as a bonding layer to join the HDPE layer and the PET layer. The PET is chemically primed for use with the LDPE which is applied hot (about 600° F.) as the bonding layer between PET and HDPE. The polyethylene layer (preferably LDPE) is preferably opaque, in particular white, to provide a background color for the printing, and provides opacity to present an aesthetically more uniform appearance between regions that are heat-affected by sealing and those regions further from the sealing surface. The polyester-urethane layer 117, which is very thin and less than 1 mil, preferably only about 0.1 mil, acts as a bonding layer to join the HDPE layer 116 and the LDPE-EVA sealing layer 118. The LDPE-EVA of layer 118 is particularly suited for providing a seal to polypropylene in container 12. It is understood that the amount of EVA in the sealing layer 118 can be varied depending on the material of container 12. It is further understood that if using radio frequency or ultrasonic sealing, it would be possible to omit a distinct lower sealing layer 118. The sealing layer 118 is preferably not thicker than 1.25 mil or else its bulk may outstrip the deadfold capability of the HDPE layer to remain peeled back.

Figure 6:
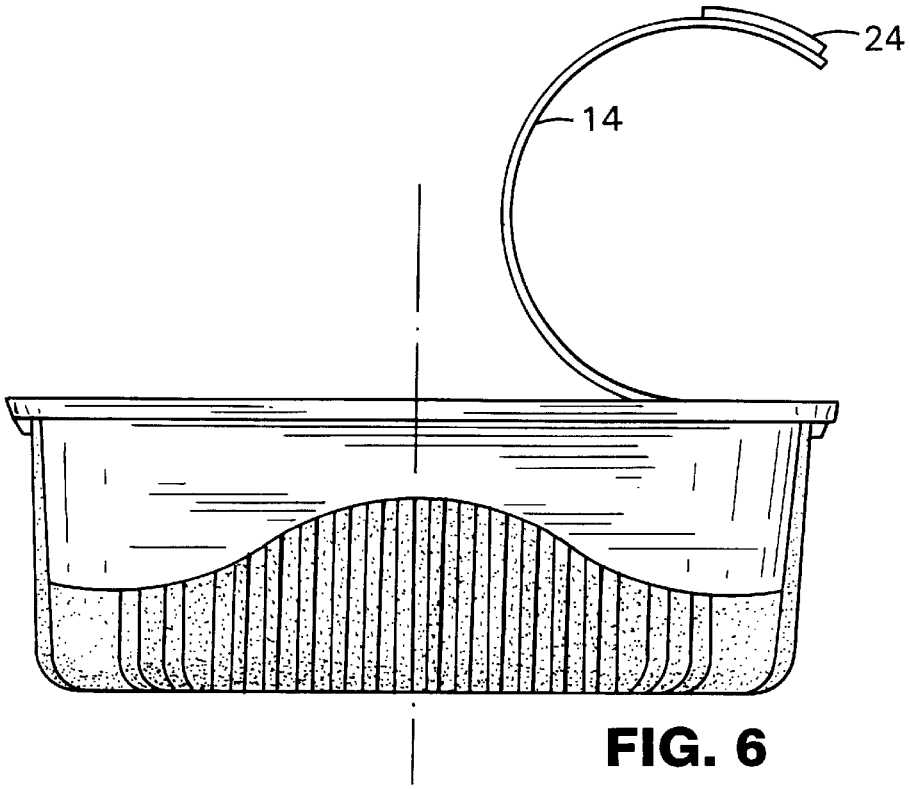
FIG. 6 shows an opened cover sheet of the FIG. 3 package remaining in a stable first exemplary peeled back condition.
Figure 7:
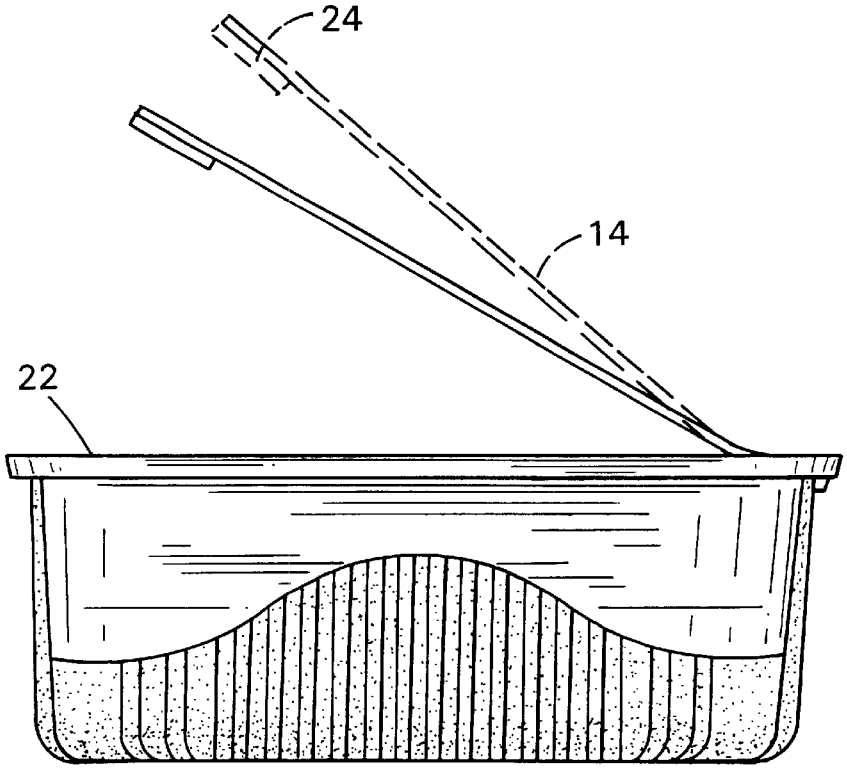
FIG. 7 shows an opened cover sheet of the FIG. 3 package remaining in a stable second exemplary peeled back condition.

"Deadfold" characteristics for the laminate are proviided by the LDPE and HDPE layers, primarily the HDPE layer. The deadfold characteristics are such that when cover sheet 14 is peeled open with a portion still attached to the container 12, and then released by the user's hand, sheet 14 remains folded back or bended back after opening, as is shown in FIGS. 3–4 and FIGS. 6–7, to permit easy access to the cartridge. In the case of stored articles that could be accessed by a user's hands, the deadfold characteristic is such that there is substantially unobstructed access to a digit of the hand while accessing the article inside. In general, as is shown in FIG. 6, sufficient deadfold results when the angle between the removed portion and sealing surface 22 is greater than 30° and most preferably greater than 45° (schematically depicted in dotted line position). Viewed another way, as shown for example in FIG. 6 or 7, sufficient deadfold results in the removed portion of the cover sheet remaining behind a position to expose at least halfway the area of the entrance to the container to permit substantially unimpeded access to a stored object. Preferably, as is shown in FIG. 7, the removed portion of the cover sheet generally remains behind a midline through the container half-way between side surfaces. In particular, cover sheet 14 remains folded back sufficiently such that the handle is substantially unobstructed while connecting to the cartridge, and the cartridge can be removed without a substantial impediment.

The moisture vapor barrier properties are provided by the LDPE and HDPE layers, primarily the HDPE layer. The moisture barrier property of the sheet can be expressed in terms of the Moisture Vapor Transmission Rate (MVTR). It is preferred that the MVTR be less than or equal to about 0.16 $\mu$m of water per 100 square inches per 24 hours, under conditions of 100° F. (37.8° C.) and 90% relative humidity.

The use of the HDPE layer together with the LDPE layer advantageously provides the desired combination of deadfold characteristics and moisture barrier properties. Further, the cover sheet is improved by the use of the LDPE layer being sandwiched between an outer PET layer and the HDPE layer to give the additional benefit of protecting the film integrity, such as the resistance to tearing and integrity of the printing.

The plastic sheet structure of cover 14, rather than metal foil, is preferred because it meets EAS requirements. In an EAS system, small tags (which commonly contain metal inside them) on the products are deactivated at time of payment so as to not set off an alarm when a paying customer leaves the store. If metal foil were used on a package containing a shaving cartridge, the combination of metal foil and metal blades in close proximity could interfere with proper functioning of the EAS tag.

Cover sheet 14 maintains structural integrity and does not delaminate, does not tear when being removed (i.e., is removable in one piece), and does not degrade in the presence of water and household cleaning agents (which, e.g., might be used in a bath tub) or shaving reparation products, protects articles stored therein from moisture and cleaning agents, has desired deadfold characteristics for ease of product removal, is less expensive than the known metal foils, is printable, and does not interfere with EAS systems. The deadfold characteristic permits opening the package for use without having to separate the lid completely from the container, which simplifies one-piece disposal and promotes good waste stream management and recycling of all-plastic materials.

Other embodiments of the invention are within the scope of the claims. E.g., a metallized plastic layer, as for example formed by vapor deposition, could be used in small amounts without interfering with EAS systems, for a desired aesthetic appearance.

What is claimed is:

1. A sealed package for an article of personal use, comprising a plastic container defining a storage region and having a sealing surface around an entrance to said region, and a metal foil-less, laminate film sealed to said sealing surface, said film comprising a plurality of plastic layers, wherein at least one of said layers is a structural plastic layer having deadfold characteristics, said film being removable away from said sealing surface in one piece and having deadfold characteristics.

2. The sealed package of claim 1, wherein said plurality of plastic layers includes a further layer that is bondable to said scaling surface.

3. The sealed package of claim 2, wherein said further layer is a sealing layer comprising ethylene vinyl acetate.

4. The sealed package of claim 2, wherein said further layer is a sealing layer comprising low density polyethylene.

5. The sealed package of claim 2, wherein said further layer is a sealing layer comprising low density polyethylene and ethylene vinyl acetate.

6. The sealed package of claim 1, wherein said plurality of plastic layers comprises a layer comprising HDPE and a layer comprising LDPE.

7. The sealed package of claim 1, wherein said plurality of plastic layers comprises a layer comprising HDPE.

8. The sealed package of claim 1, wherein the plurality of layers comprises an outer layer comprising PET and further comprising an inner layer comprising HDPE underneath said outer layer.

9. The sealed package of claim 8, wherein the structural layer further comprises a further inner layer comprising LDPE.

10. The sealed package of claim 8, further comprising an inner layer comprising polyester-urethane between said layer comprising HDPE and said bondable layer.

11. The sealed package of claim 1, wherein one of said layers is a metallized plastic layer.

12. The sealed package of claim 1, wherein the layer adjacent the sealing surface is heat sealable to the sealing surface.

13. The sealed package of claim 1, wherein the layer adjacent the sealing surface is sealable to the sealing surface by RF welding.

14. The sealed package of claim 1, wherein the layer adjacent the sealing surface comprises a pressure sensitive adhesive.

15. The sealed package of claim 1, wherein said laminate has moisture barrier properties.

16. The sealed package of claim 1, wherein said laminate has chemical resistance properties.

17. The sealed package of claim 1, wherein said laminate is delamination-resistant in the presence of a manual force removing said film from said container sealing surface.

18. The sealed package of claim 1, wherein said laminate is degradation-resistant in the presence of water and household cleaning agents.

19. The sealed package of claim 1, wherein said laminate carries printing on an internal surface of a said layer.

20. The sealed package of claim 1, wherein the container includes polypropylene.

21. The sealed package of claim 2, wherein the container includes polypropylene, and said further layer also comprises EVA.

22. A sealed package for an article of personal use, comprising a plastic container defining a storage region and having a sealing surface around an entrance to said region, and a metal foil-less, laminate film sealed to said sealing surface, said film comprising a plurality of plastic layers, said film being removable away from said sealing surface in one piece and having deadfold characteristics, and wherein said deadfold characteristics are such that there is substantially unobstucted access to a digit of the hand while accessing an article in said storage region.

23. The sealed package of claim 1 wherein said deadfold characteristics are such that the angle between the removed portion of said film and said sealing surface is greater than 30°.

24. The sealed package of claim 1 wherein said deadfold characteristics are such that the angle between the removed portion of said film and said sealing surface is greater than 45°.

25. A sealed package for an article of personal use, comprising a plastic container defining a storage region and having a sealing surface around an entrance to said regions, and a metal foil-less, laminate film sealed to said sealing surface, said film comprising a plurality of plastic layers, said film being removable away from said sealing surface in one piece and having deadfold characteristics, and wherein said deadfold characteristics are such that a partially removed portion of said film remains behind a position to expose at least halfway the area of said entrance to said storage region to permit substantially unimpeded access to a stored article in said region.

26. A sealed package for an article of personal use, comprising a plastic container defining a storage region and having a sealing surface around an entrance to said region, and a metal foil-less, laminate film sealed to said sealing surface, said film comprising a plurality of plastic layers, said film being removable away from said sealing surface in one piece and having deadfold characteristics, and wherein said container has side surfaces, and said deadfold characteristics are such that a partially removed portion of said film generally-remains behind a midline through the container half-way between said side surfaces.

27. The sealed package of claim 1 wherein said deadfold characteristics are such that the removed portion of said film remains folded back sufficiently such that a razor handle is substantially unobstructed while connecting to a cartridge in said storage region, and the cartridge can be removed without a substantial impediment.

28. The sealed package of claim 7, wherein said plurality of plastic layers further comprises a layer comprising polyethylene terephthalate (PET).

29. The sealed package of claim 1, wherein said plurality of plastic layers has an upper layer comprising polyethylene terephthalate (PET).

30. The sealed package of claim 1, wherein said metal foil-less laminate film is paper-less.

31. The sealed package of claim 30, wherein said plurality of plastic layers comprises a layer comprising polyethylene terephthalate (PET).

32. The sealed package of claim 31, wherein said plurality of plastic layers flier comprises a layer comprising HDPE.

33. The sealed package of claim 1, wherein said laminate film has a thickness in the range of between about 2.13 mil (0.0564 mm) and about 4.38 mil (0.111 mm).

34. A sealed package for an article of personal use, comprising a plastic container defining a storage region and having a sealing surface around an entrance to said region, and a paperless metal-foil-less, laminate plastic film sealed to said sealing surface, wherein at least one of a plurality of plastic layers of said laminate film is a structural plastic layer having deadfold characteristics, said film comprising an uppermost skin layer comprising a polyethylene terephthalate (PET) and having an uppers surface and a lower surface, a first intermediate layer having a surface coextensively adherent to said lower surface of said uppermost skin layer, and a base layer comprising a high density polyethylene (HDPE) and having an upper surface and a lower surface, said upper surface coextensively adherent to and disposed beneath said first intermediate layer, said film being removable away from said sealing surface in one piece and having dead fold characteristics.

35. The sealed package of claim 34, wherein said first intermediate layer comprises a low density polyethylene (LDPE).

36. The sealed package of claim 34, wherein said laminate film further comprises a sealing structure disposed beneath said HDPE base layer and bondable to said sealing surface and comprising a second bonding layer having a surface coextensively adherent to said lower surface of said HDPE base layer, and a lowermost sealing layer containing at least one polymer selected from the group of polymers consisting of (i) polyethylene, (ii) ethylene vinyl acetate (EVA), and (iii) polyethylene-EVA.

37. The sealed package of claim 36, wherein said second bonding layer comprises a urethane.

38. A paperless, metal foil-less lidding material comprising a plastic laminate structural film for the manufacture of a sealed package for an article of personal use receivable within a plastic container defining a storage region and having a sealing surface around an entrance to said region, said plastic laminate structural film having at least one plastic structural layer having deadfold characteristics, and said plastic laminate structural film consisting essentially of an upper layer of polyethylene tereplithalate (PET), a second layer of low density polyethylene (LDPE), and a base layer of high density polyethylene (HDPE), said lidding material being removable away from said sealing surface in one piece and having deadfold characteristics.

39. The lidding material of claim 38, wherein said upper layer is outermost and said second layer is intermediate the upper and the base layers.

40. The lidding material of claim 38 further including a sealing region adhered below said plastic structural film, said sealing region being bondable to said sealing surface of said plastic container and comprising a bonding layer having a surface coextensively adherent to a lower surface of said plastic laminate structural film, and a lowermost sealing layer containing at least one polymer selected from the group of polymers consisting of (i) polyethylene, (ii) ethylene vinyl acetate (EVA), and (iii) poyethylene-EVA.

* * * * *

UNITED STATES PATENT AND TRADEMARK OFFICE

CERTIFICATE OF CORRECTION

PATENT NO. : 6,413,599 B1
DATED : July 2, 2002
INVENTOR(S) : Petricca et al.

It is certified that error appears in the above-identified patent and that said Letters Patent is hereby corrected as shown below:

Column 6,
Line 22, change “unobstucted” to -- unobstructed --;

Column 7,
Line 13, change “flier” to -- further --;
Line 27, change “uppers” to -- upper --.

Signed and Sealed this

Fourteenth Day of January, 2003

JAMES E. ROGAN
*Director of the United States Patent and Trademark Office*